United States Patent [19]

Handerhan

[11] 4,039,996

[45] Aug. 2, 1977

[54] ELECTRIC HEATING ELEMENTS

[75] Inventor: Joseph P. Handerhan, Pittsburgh, Pa.

[73] Assignee: Emerson Electric Co., St. Louis, Mo.

[21] Appl. No.: 682,956

[22] Filed: May 4, 1976

[51] Int. Cl.[2] ..... H01C 7/22

[52] U.S. Cl. ..... 338/295; 219/546; 338/243; 338/261; 338/270; 338/274

[58] Field of Search ..... 338/238, 243, 239, 260, 338/261, 267, 273, 274, 270, 295, 325; 29/610, 611, 621; 219/544, 546, 523

[56] References Cited

U.S. PATENT DOCUMENTS

| | | | |
|---|---|---|---|
| 3,217,279 | 11/1965 | Boggs | 338/274 X |
| 3,307,135 | 2/1967 | Simmons | 338/239 |

*Primary Examiner*—C. L. Albritton
*Attorney, Agent, or Firm*—Michael Williams

[57] ABSTRACT

An electric heating element, particularly of the cartridge type, comprising two elongated dielectric cores disposed within a metallic sheath. Each core has a plurality of longitudinally extending openings therein and more particularly one core has three longitudinal openings whereas the other has two openings. A resistance wire coil is wound on each of the cores, each coil having longitudinally spaced terminals. Three metal pins fit into predetermined core openings; one of the terminals of each resistance coil is electrically connected to one pin, the opposite terminal of one resistance coil is electrically connected to a second pin; and the opposite terminal of the other resistance coil is electrically connected to the third pin; whereby the one pin serves as a common electrical connection for both resistance coils, and the second and third pins serve as separate electrical connections to the respective resistance coils, whereby separate circuits may be established within the heating element.

6 Claims, 4 Drawing Figures

ELECTRIC HEATING ELEMENTS

BACKGROUND AND SUMMARY

The present invention relates to new and useful improvements in electric resistance heating elements, particularly of the cartridge type. The following U. S. patents afford an understanding of the prior art as presently known by applicant:

| | | |
|---|---|---|
| 2 831 951 | Desloge | Apr 22, 1958 |
| 2 977 453 | Wells | Mar 28, 1961 |
| 3 134 956 | Boggs | May 26, 1964 |
| 3 219 279 | Boggs | Nov 9, 1965 |
| 3 307 135 | Simmons | Feb 28, 1967 |
| 3 812 580 | Drugmand | May 28, 1974 |

My invention distinguishes from the above in that it provides for energization of separate circuits within the cartridge element, through use of one voltage source to energize one coil, and a different voltage source to energize the other coil. For example, one voltage may be 120 volts whereas the other may be 12 volts. Establishment of separate circuits of different voltages is made possible by electrically connecting the heating coils so that two each have one end in common connection with one terminal, and the other ends of the coils have connection with respective second and third terminals.

DESCRIPTION OF THE DRAWING

In the drawing accompanying this specification and forming a part of this application, there are shown, for purpose of illustration, several embodiments which my invention may assume and in this drawing.

DESCRIPTION OF THE PREFERRED EMBODIMENT

Figure 1:
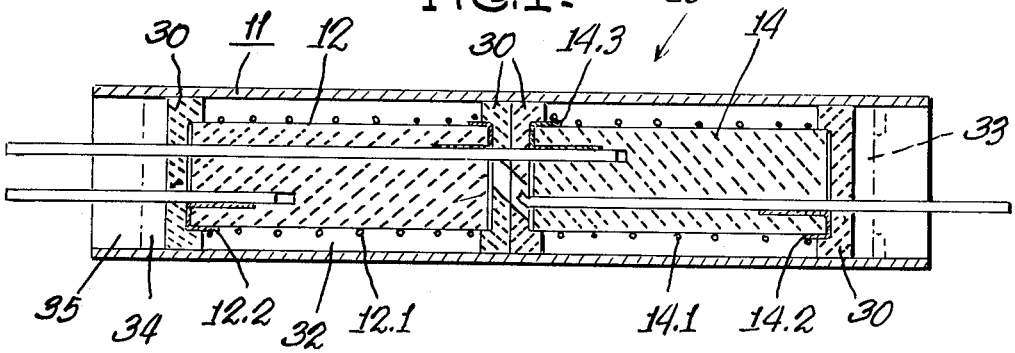
FIG. 1 is a longitudinal sectional view through a preferred embodiment of my invention, showing disposition of parts prior to final working of the cartridge heater.

FIG. 1 is a longitudinal sectional view through a cartridge heater 10, and is similar to FIG. 1 of Boggs U.S. Pat. No. 3,217,279, and reference is made to the description in that patent for details in the manufacture of this type of heater.

In FIG. 1 of this application, a tubular metal sheath 11 is adapted to house the components of the cartridge heater, the sheath being shown in an intermediate stage of manufacture. FIG. 1 shows two ceramic cores 12 and 14 disposed in longitudinal alignment within the sheath, each core having an outside diameter which is considerably less than the inside diameter of the sheath to provide an annular space which is subsequently filled with powdered refractory material.

Figure 2:
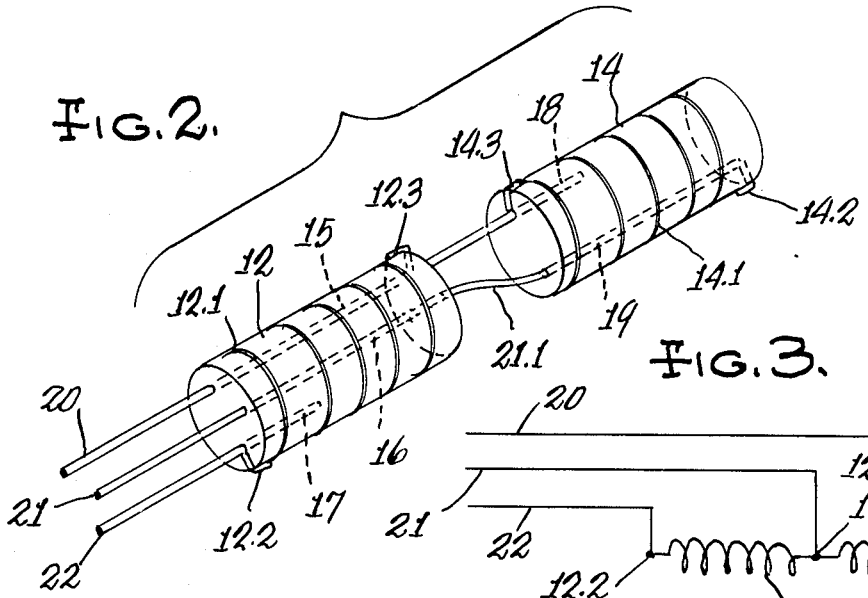
FIG. 2 is a perspective view showing various parts of FIG. 1 in disassembled relation.

As seen in FIG. 2, the core 12 has three longitudinal openings 15, 16, and 17, and at least two of these extend completely through the core. The openings 17 is shown to extend only part way through the core, although it, too, may extend completely through the core. The core 14 has two lontitudinal openings 18 and 19, with the opening 18 extending only part way through the core, although it may also extend completely through the core.

The openings 15, 16, and 17 are spaced radially 120° apart, with centers on a circle, the center of which is the center of the core 12. The openings 18 and 19 in core 14 are adapted to align axially with core openings 15 and 17, respectively. Each core has a resistance wire coil wound thereabout, the coil on the core 12 being designated 12.1 and the coil on the core 14 being designated 14.1. Opposite ends of each coil terminate adjacent to opposite ends of a respective core and are either inserted into core openings or, as shown in the said Boggs patent, are attached to thin metal members which are inserted into the core openings.

As best seen in FIG. 2, one terminal 12.2 is inserted into opening 17 at one end of the core 12, and the opposite terminal 12.3 is inserted into opening 15 at the opposite end of the core. One terminal 14.2 of coil 14.1 is inserted into opening 19 of the core 14, and the other terminal 14.3 is inserted into opening 18 at the opposite end of the core.

Three terminal pins 20, 21 and 22 are adapted to be inserted within respective core openings 15, 16 and 17. These pins may be in the form of small diameter metal rods and preferably the pin 21 should possess some flexibility, such as afforded by the stranded terminal conductors shown in Drugmand U.S. Pat. No. 3,812,580. As seen in FIG. 2, the terminal pin 21 extends completely through the openings 16 and 19 of respective cores 12 and 14, and has an off-set portion 21.1 intermediate the cores. The terminal pin 21 electrically engages the terminal 14.2 of the coil 14.1. The terminal pin 21 electrically extends through the opening 15 in core 12 and into the opening 18 in core 14, and electrically engages terminals 12.3 and 14.3 to provide a common electrical connection between coils 12.1 and 14.1. Terminal pin 22 extends into opening 17 of core 12 and electrically engages the terminal 12.2 of coil 12.1.

Figure 3:
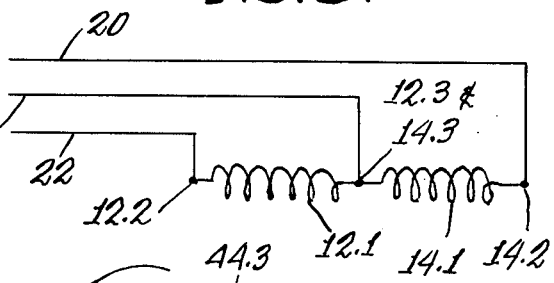
FIG. 3 is a circuit diagram of the electrical connections made possible through use of my invention and FIG. 4 is a perspective view similar to FIG. 2, but showing a slight variation in construction.

The electrical circuit made by the connection of pins with the coil terminals is shown diagramatically in FIG. 3, and the construction enables all terminal pins to extend from one end of the sheath 11, a requirement for cartridge heater purposes. The coils 12.1 and 14.1 may have the same or different resistivity. Switches, not shown, may be inserted in the electrical lines leading from different current sources to the terminal pins 20, 21 and 22. Thus, the common terminal pin 20 may be connected to one side of each of two different sources of current and the other lines of such sources may be respectively connected to the terminal pins 21 and 22. By proper switching arrangement, one or the other of the coils may be energized. One source may be 12 volts and the other 120 volts. Further voltage sources for the coils may be such that one coil operates at 100 watts and the other coil at 200 watts.

As seen in FIG. 1, ceramic spacer discs 30 are disposed at opposite ends of the core assembly, and between the cores 12 and 14, the discs being cup-shaped to fit over respective core ends to center the cores. The discs between the cores will have a channel to pass the offset portion 21.1 of the terminal pin 21; and all discs will have openings therethrough to pass the terminal pins. Each of the discs 30 has a toothed periphery, somewhat like a spur gear, with the outer portions of the teeth slidably fitting the inner wall of the sheath to center the core assembly within the sheath. The spaces between the teeth provide openings through which granular refractory material may flow to fill the annular space 32 between the exterior of the cores and the interior wall of the sheath. Commonly, a bushing (not shown) is disposed within one open end of the sheath and granular refractory material is poured into the other end. A bushing is then disposed within such other sheath end and the sheath is subjected to a swaging operation to transversely reduce the same. The swaging operation crushes the cores 12 and 14 and transforms them and the refractory material within the sheath space into a rock like homogenous mass.

The closure bushings are then removed and the sheath is end-trimmed to a predetermined length and the terminal pins at the right hand end of the sheath are cropped so that they do not extend beyond the disc 30 at such end. A suitable insulating bushing 33 is then inserted into the right hand end of the sheath and this end is closed over a metal disc. A suitable insulating bushing 34 is inserted within the left hand end of the sheath and the space 35 is sealed by a suitable cement.

DESCRIPTION OF OTHER EMBODIMENT

Figure 4:
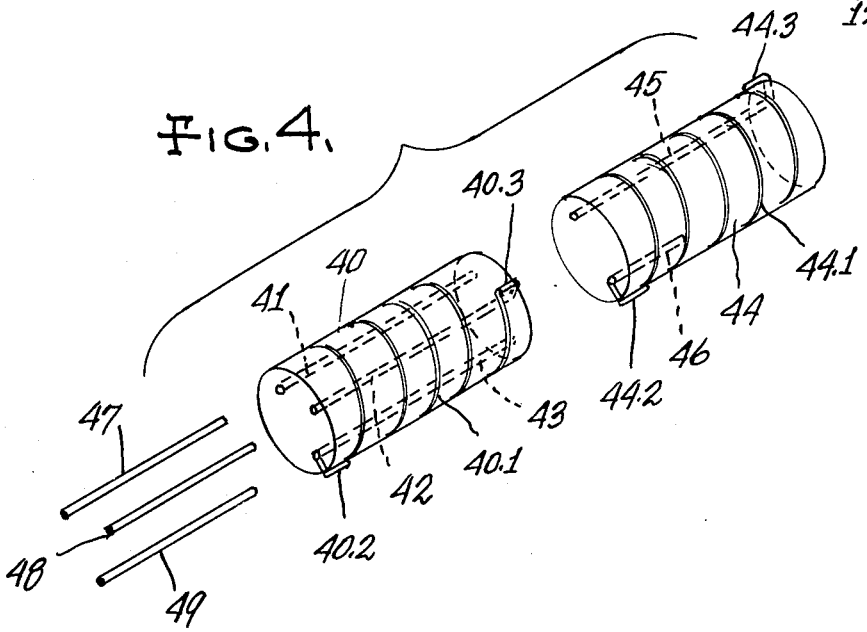

The embodiment shown in FIG. 4 is similar to that hereinbefore described, except that the construction eliminates need for the offset 21.1 of the terminal pin 21. In FIG. 4, the ceramic core 40 has a resistance coil 40.1 wound thereon, and is provided with three longitudinal openings 41, 42 and 43 therethrough. One terminal 40.2 of the coil 40.1 extends into the opening 43 at one end of the core, and the other coil terminal 40.3 extends into the opening 42 at the other end of the core.

The ceramic core 44 has a resistance coil 44.1 wound thereon, and is provided with two longitudinal openings 45 and 46; at least the opening 45 extending therethrough. One terminal 44.2 of the coil 44.1 extends into the opening 46 at one end of the core, and the other terminal 44.3 extends into the opening 45 at the other end of the core.

The three terminal pins 47, 48 and 49 may in this instance all be rigid metal rods of small diameter. The terminal pin 47 is adapted to extend through the aligned openings 41 and 45 and into electrical engagement with the terminal 44.3. The terminal pin 48 need only extend through the opening 42 of the core 40 and its inner end is adapted to electrically engage the terminal 40.3. The terminal pin 49 is adapted to extend completely through the opening 43 of the core 40 and into the short opening 46 in core 44, and is adapted to electrically engage terminals 40.2 and 44.2. Thus terminal pin 49 will act as the common electrical connection for coils 40.1 and 44.1, so that the coils may be selectively energizes as before.

I claim:

1. An electric resistance heating element, comprising:

a pair of elongated dielectric bodies, one having three openings extending longitudinally therein, and the other having two openings extending longitudinally therein, three metallic terminal pins fitting into respective openings /the opening/ of said one body, and one of said pins fitting within an opening of said other body to maintain the bodies in longitudinally aligned relation, a resistor coil wound on the surface of each of said bodies, each coil having opposed terminals at opposite ends of its respective body and extending into different body openings, one of said terminal pins being electrically connected to a terminal of each coil, a second terminal pin being electrically connected to the opposite terminal of one coil, and a third terminal pin being electrically connected to the opposite terminal of the other coil.

2. The construction according to claim 1 wherein said second terminal pin extens through the opening of said one body without engaging either terminal of the coil wound thereon and extends into one of the openings in said other body and electrically engages said opposite terminal of the coil wound thereon.

3. The construction according to claim 1 wherein said second terminal pin has an offset portion between said dielectric bodies to permit it to extend from the opening in said one body to a non-aligned opening in said other body.

4. The construction according to claim 1 wherein two of said three openings in said one body are axially aligned with the two openings in said other body, said one terminal pin extending into one pair of axially aligned openings.

5. The construction according to claim 4 wherein said second terminal pin extends through the third opening in said one body and has an offset portion intermediate said bodies to permit it to extend into the other opening in said second body.

6. The construction according to claim 4 wherein said second terminal pin extends through the other pair of aligned openings, and the third terminal pin extends into the third opening of said one body.

* * * * *